US011590556B2

(12) United States Patent
Viviroli et al.

(10) Patent No.: US 11,590,556 B2
(45) Date of Patent: Feb. 28, 2023

(54) STRAIGHTENER FOR STRAIGHTENING CABLES

(71) Applicant: Komax Holding AG, Dierikon (CH)

(72) Inventors: Stefan Viviroli, Horw (CH); Marco Della Torre, Sachseln (CH)

(73) Assignee: Komax Holding AG, Dierikon (CH)

( * ) Notice: Subject to any disclaimer, the term of this patent is extended or adjusted under 35 U.S.C. 154(b) by 43 days.

(21) Appl. No.: 16/949,178

(22) Filed: Oct. 19, 2020

(65) Prior Publication Data

US 2021/0114079 A1 Apr. 22, 2021

(30) Foreign Application Priority Data

Oct. 21, 2019 (EP) ..... 19204346

(51) Int. Cl.

| | |
|---|---|
| ***B21F 1/02*** | (2006.01) |
| ***B21D 3/05*** | (2006.01) |
| ***H01R 43/28*** | (2006.01) |
| ***B21F 11/00*** | (2006.01) |
| ***B21F 23/00*** | (2006.01) |

(52) U.S. Cl.
CPC ..... *B21F 1/02* (2013.01)

(58) Field of Classification Search
CPC . B21F 1/02; B21F 23/00; B21F 11/00; B21D 3/05; H01R 43/28
USPC ..... 140/147
See application file for complete search history.

(56) References Cited

U.S. PATENT DOCUMENTS 4,005,592 A * 2/1977 Haeussler ..... B21F 1/02 72/165
5,467,629 A 11/1995 Albert
5,676,010 A * 10/1997 College ..... B21D 3/05 72/162
6,085,564 A 7/2000 Veit et al.
8,978,435 B2 3/2015 Viviroli
(Continued)

FOREIGN PATENT DOCUMENTS

CN 205702240 U 11/2016
CN 206392758 U * 8/2017
CN 206392758 U 8/2017
(Continued)

OTHER PUBLICATIONS

English translate (CN206392758U), retrived date Mar. 16, 2022.*

*Primary Examiner* — Adam J Eiseman
*Assistant Examiner* — Mohammed S. Alawadi
(74) *Attorney, Agent, or Firm* — William J. Clemens; Shumaker, Loop & Kendrick, LLP

(57) ABSTRACT

A straightening apparatus for straightening cables includes a first roller group having several rollers and a second roller group having several rollers opposite the first roller group. The cable alternates in a transport direction between the rollers of the first roller group and the rollers of the second roller group. The straightening apparatus further includes an infeed device with which the first roller group can be displaced in a closing direction against the second roller group. In order to secure the position of the first roller group displaced in the closing direction by the infeed device, the straightening apparatus includes a backstop which blocks a backward movement of the first roller group against the closing direction. The backstop has a clamping roller which is received in a wedge gap.

19 Claims, 5 Drawing Sheets

(56) References Cited

U.S. PATENT DOCUMENTS

| | | | | |
|---|---|---|---|---|
| 10,773,285 | B2 | 9/2020 | Viviroli | |
| 2011/0315266 | A1* | 12/2011 | Viviroli | B65H 57/14<br>140/147 |

FOREIGN PATENT DOCUMENTS

| | | | |
|---|---|---|---|
| CN | 207709736 | U | 8/2018 |
| DE | 19828675 | A1 | 2/2000 |
| EP | 0619155 | A1 | 3/1994 |
| EP | 2399856 | A1 | 12/2011 |
| EP | 3184191 | A1 | 6/2017 |

* cited by examiner

STRAIGHTENER FOR STRAIGHTENING CABLES

FIELD

The invention relates to a straightening apparatus for straightening cables that can be part of a cable processing machine. Such cable processing machines are used for the assembly of electrical cables. When assembling cables, cables can be cut to length and stripped and then the cable ends can be crimped. The cable processing machines can further comprise grommet stations in which the stripped cable ends are fitted with grommets before crimping.

BACKGROUND

The cables, such as insulated strands or solid conductors made of copper or steel, which are processed on a cable processing machine, are usually provided in drums, on rolls or as a bundle and are therefore more or less curved and provided with a twist after unrolling. Straight cables are important in order to be able to reliably carry out process steps such as stripping, crimping and possibly fitting with connector housings provided on the cable processing machine. In order to straighten the cables as straight as possible, they are usually pulled with the help of the drives in the cable processing machine through a straightening apparatus attached to the machine inlet.

A generically comparable straightening apparatus is known, for example, from EP 2 399 856 A1. The straightening apparatus has an upper and a lower roller group. The cable to be straightened is passed between the rollers of the two roller groups in a transport direction. The roller groups can be moved relative to one another to set the straightening parameters. Starting from an open position in a closing direction that is perpendicular to the direction of transport of the cable, the upper roller group is first displaced against the lower roller group into a closed position. In this closed position, the parallel rollers of the upper and lower roller group are on the cable and touch it. This process is also known and familiar to the person skilled in the art under the name "infeeding". The distance between the rollers can be set manually using a rotary knob. An additional quick-release lever enables the straightening apparatus to be opened and closed quickly when the cable is removed and inserted between the rollers. Alternatively, the roller spacing can also be set automatically. For this purpose, the infeed mechanism for displacing the upper roller group against the lower roller group is provided with a motor drive, for example. However, this variant is technically complex and costly.

SUMMARY

It is an object of the present invention to avoid the disadvantages of the known and in particular to provide an improved straightening apparatus of the type mentioned at the outset. According to the invention, this task is achieved by a straightening apparatus having the features described below.

The straightening apparatus for straightening cables comprises a first roller group having a plurality of rollers and a second roller group having a plurality of rollers opposite the first roller group, wherein the cable alternates between the rollers of the first roller group in a transport direction and the rollers of the second roller group. The straightening apparatus further comprises, for example, a manually operable or motor-driven infeed device with which the first roller group can be displaced against the second roller group. The fact that the straightening apparatus includes securing means for securing the first roller group in terms of position enables the roller spacing to be set precisely. The infeeding, i.e. the process in which the first roller group is brought from an open position to a closed position, can be carried out in an efficient manner.

Thanks to the infeed device, the first roller group, starting from the open position in the closing direction, which runs transversely and preferably at right angles to the transport direction, can be displaced against the second roller group for adjusting the distance between the rollers of the first and the second roller group. The open position is the position in which the rollers of the first and the second row of rollers are spaced apart so far that the cable can be inserted between the rollers. The closed position is the position after the end of the displacement movement; the infeeding process is complete. In the closed position, the rollers of the first and the second roller group touch the ideal cable in such a way that it is straight and not wavy.

The straightening apparatus can have a first roller support for the first roller group, to which the rollers of the first roller group are fastened in a freely rotatable manner, and a second roller support for the second roller group, to which the rollers of the second roller group are fastened in a freely rotatable manner. Furthermore, the straightening apparatus may have a frame, for example in the form of a base plate, for carrying the first and the second roller support, wherein the first roller support is displaceably mounted in the frame in the closing direction.

In a preferred embodiment, the straightening apparatus for forming the securing means may comprise a backstop which blocks a backward movement of the first roller group against the closing direction during the infeed process. Thanks to the backstop, the straightening apparatus can be operated reliably, ergonomically and efficiently with regard to the infeed process.

For this purpose, discrete backstops such as backstops based on a ratchet mechanism can be provided. Such a ratchet mechanism can comprise, for example, a toothing and a pawl interacting with it. With the ratchet mechanism, however, pilgering movements would be possible. It is therefore advantageous that the infeed device of the straightening apparatus comprises a stepless backstop. Stepless backstops have the advantage that they can prevent practically all unwanted back movements.

The aforementioned backstop can be configured as a backstop with a positive fit. The backstop can also be configured as a non-positive backstop. In addition to mechanical backstops, other backstops are also conceivable. The backstop could be a hydraulic cylinder; if the roller support wants to move back, the outflow of hydraulic oil from the hydraulic cylinder is prevented by check valves and thus the backstop is effective.

It is also advantageous if the first roller support is supported on the frame by a spring element, in particular a helical compression spring, which acts on the first roller support with a spring force against the closing direction. Safe functioning of the backstop can thus easily be guaranteed.

The backstop can comprise a clamping body and in particular a clamping roller, wherein the clamping body or the clamping roller is received in a wedge gap. The wedge gap can be a receptacle for the clamping body that tapers in relation to the closing direction. Due to the wedge effect, the clamping body pressed into the wedge gap can reliably block a return movement of the first roller support.

The backstop can comprise a spring for generating a pretension for the clamping body, in particular the clamping roller. The spring-loaded clamping body is pressed continuously into the wedge gap, thus ensuring that the backstop functions reliably.

The first roller support can have a wedge-shaped contact surface which, together with a stationary counter surface, forms the wedge gap. The stationary counter surface can be formed, for example, by a guide surface assigned to the frame, along which the first roller support can be guided during the closing process.

Alternative backstops could comprise two wedges, wherein the wedges have oppositely directed, oblique wedge surfaces which, if a return movement would take place, are pressed against one another and thus prevent the return movement. Other alternative backstops could include eccentric bodies.

The straightening apparatus can have a manually actuated infeed device with an operating element that can be moved linearly in the closing direction, in particular in the form of a button, by means of which the first roller support or the first roller group can be displaced in the closing direction, for example by pressing the operating element. Such a straightening apparatus is characterized by simple handling and good ergonomics. The operating element simply has to be pressed for infeeding. A quick release lever for quick closing is also not required.

A driver can be connected to the operating element for advancing the first roller support. The driver can connect to a shaft of the operating element or be formed by the shaft itself. The shaft is an elongated component that extends in the closing direction. The driver or the shaft can be slidably mounted in the frame and can be moved in the closing direction (and possibly in the opposite direction). The driver bumps against the first roller support when it is pressed by pressing the button-like operating element or when it is moved in the closing direction in some other way and thus displaces the first roller support in the closing direction. A straightening apparatus with a motor-driven infeed device can also have such a driver.

The backstop is preferably configured as a releasable backstop. For this purpose, an unlocking element may be provided to release the locking effect of the backstop.

An unlocking element for releasing the locking effect can be arranged on the driver or connected to the driver. The driver with the unlocking element is configured in such a way that during a return movement, that is to say during a movement in the opposite direction to the closing direction, the unlocking element can be brought into abutment with the clamping body. The unlocking element may be a nose-like projection protruding from the driver or the shaft. To release the locking effect, the unlocking element may push the clamping body away, so that the clamping body no longer contacts the wedge-shaped contact surface of the wedge gap, that is to say there is no longer any clamping.

The locking effect can be released by pulling the button-like operating element. This solution is characterized by simple handling. Other means could also be used to release the locking effect. For example, it could also be advantageous not to use the aforementioned operating element for closing the straightening apparatus for the opening process. If separate means for releasing the locking effect are used, incorrect manipulations on the operating element, which result in an unintentional release of the locking effect, can be excluded.

The straightening apparatus does not necessarily have to have a manually operated infeed device. For certain areas of application, it may be advantageous if the straightening apparatus has a drivable infeed device with a linear direct drive, a pneumatic cylinder or a hydraulic cylinder for moving the first roller support in the closing direction. Such infeed devices may be easily controlled and operated automatically or semi-automatically.

In a further embodiment, the straightening apparatus can have a contact roller for fixing the closed position, wherein the contact roller is arranged downstream of the first roller group with respect to the transport direction, and wherein the cable may be pressed between the contact roller and a counter roller assigned to the second roller group and opposite the contact roller.

Alternatively, the straightening apparatus for fixing the closed position can have at least one and preferably a plurality of contact fingers, which are preferably displaceable to a limited extent in the closing direction, wherein the at least one contact finger is assigned to one of the roller groups and in particular to the first roller group. In this case, the contact finger may in each case be arranged opposite a roller of the other roller group, in particular the second roller group, in such a way that the cable can be pressed between the respective contact finger and the opposite roller. The contact fingers can be configured such that they can be brought into a rest position by moving in the opposite direction to the closing direction after the closing position has been determined, so that they no longer act on the cable.

To further generate the straightening effect of the cable after the infeed process has ended, it is advantageous if the second roller support is rotatably mounted on the frame about a swivel axis and that the straightening apparatus has a swiveling device, for example manually operable or motor-driven, with which to set the angle of attack between the rollers of the first and the second roller group; the second roller group is preferably swivelable from a neutral position into an active position.

The second roller support can particularly preferably be rotatably mounted on the frame such that, by swiveling the second roller support, the rollers on the input side act more strongly on the cable than the rollers on the output side. The swiveling device can, for example, be a device as it is known per se from EP 2 399 856.

In one embodiment, a link guide for the movement of the first roller support and/or the second roller support can be provided.

A linearly movable thrust element can be provided for the link guide, by means of which both the first roller support and the second roller support can be moved. The thrust element can be configured to be operated manually or to be driven by a motor. In this embodiment, the two straightening parameters (roller spacing, angle of attack) can be set in a single common work step or actuation movement.

The straightening apparatus can have a manually operable thrust element with a hand lever, preferably movable back and forth in the transport direction.

On the thrust element, an infeed link guide for displacing the first roller support in the closing direction and an opening link guide for releasing the locking effect and for returning the first roller support can be arranged. In this case, a first, spring-loaded control body can interact with the infeed link guide and the opening link control. A swiveling link guide for swiveling the second roller support can be arranged on the thrust element. A second, spring-loaded control body can interact with the swiveling link guide.

The swiveling link guide can be formed by a stepped control track with preferably a plurality of receptacles for the control body for setting discrete angles of attack. This enables the attack angle to be set particularly quickly. Such a swiveling link guide could also be used in conventional straightening devices, i.e. in straightening apparatuses without a backstop or other securing means for securing the position of the first roller group shifted by means of the infeed device.

DESCRIPTION OF THE DRAWINGS

Additional advantages and individual features of the invention are derived from the following description of an exemplary embodiment and from the drawings. The drawings show the following.

DETAILED DESCRIPTION

Figure 1:
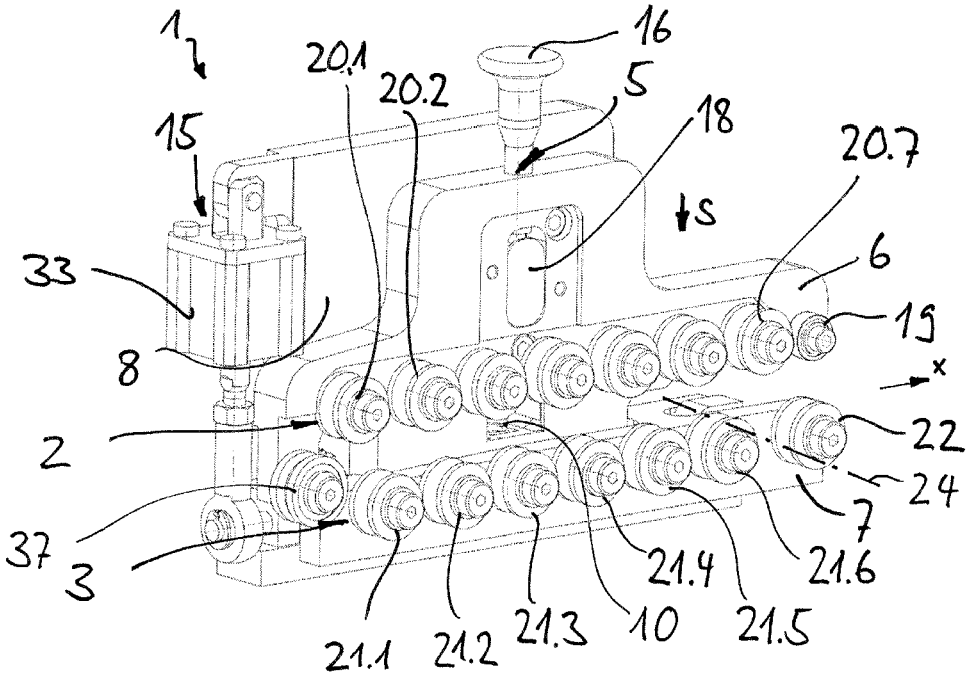
FIG. 1 is a perspective view of a straightening apparatus according to the invention for straightening cables in an open position.

FIG. 1 shows a straightening apparatus 1 for straightening cables with two opposite roller groups 2 and 3 that can be moved towards one another. A first roller group, designated by 2, has a plurality of rollers 20.1 to 20.7 arranged one behind the other in a row. A second roller group, designated by 3, has a plurality of rollers 21.1 to 21.6 arranged one behind the other in a row. In the present case, the first roller group 2 is arranged at the top of the straightening apparatus 1, which is why, for the sake of simplicity and for better understanding, this roller group is referred to as the "upper roller group"; the associated rollers 20.1 to 20.7 are accordingly "upper rollers". The roller group 3 opposite the upper roller group 2 is consequently a "lower roller group" in the present case.

Figure 2:
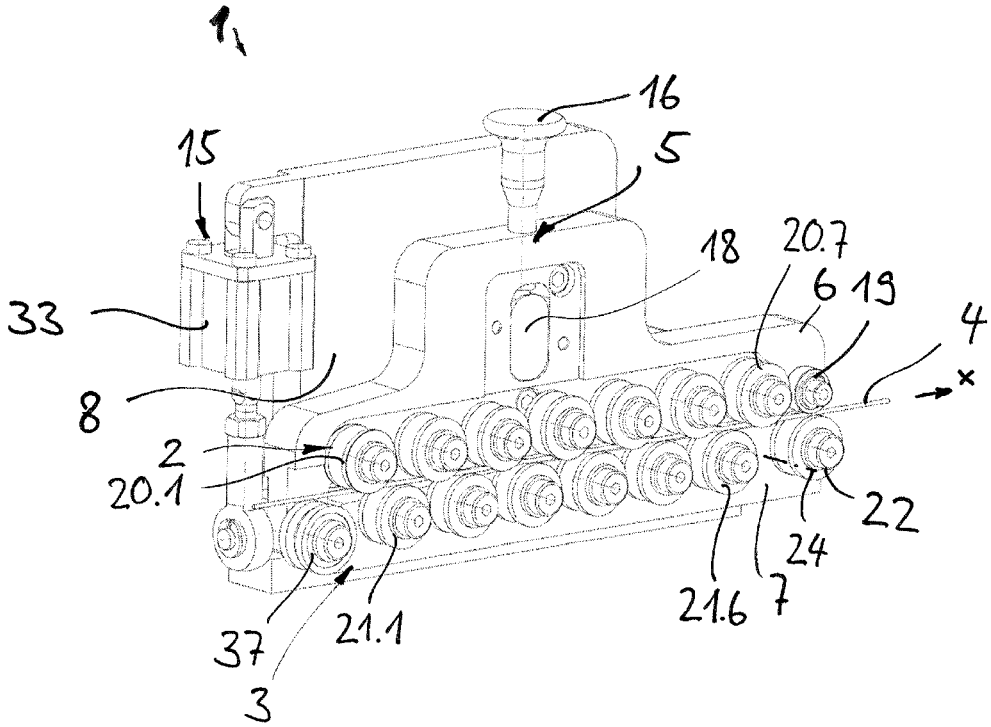
FIG. 2 shows the straightening apparatus in a closed position.

The upper rollers 20.1 to 20.7 and the lower rollers 21.1 to 21.6 run parallel to each other and are each on horizontal roller lines. The cable (not shown in FIG. 1) that runs between the upper rollers 20.1 through 20.7 and the lower rollers 21.1 through 21.6 for straightening, also runs in the horizontal direction, which is indicated by an arrow x. FIG. 1 shows the straightening apparatus 1 in an open position, in which the two roller groups 2, 3 are so far apart that a cable can be introduced or inserted between the upper rollers 20.1 to 20.7 and the lower rollers 21.1 to 21.6. Then the upper roller group 2 is moved against the lower roller group 3. This closing movement is indicated by an arrow s. The closing direction s obviously runs in the vertical direction. FIG. 2 shows the straightening apparatus 1 in a closed position or after completion of an infeed process after the upper roller group 2 has been moved in the closing direction s against the lower roller group 3. The cable 4 is now acted upon, alternating from rollers 20.1 to 20.7 and 21.1 to 21.6 of the upper and lower roller groups 2 and 3, can be pulled in the horizontal transport direction x through the straightening apparatus 1 by means of a cable conveyor (not shown).

The basic arrangement and orientation of the roller groups 2 and 3 shown here relate to embodiments of the straightening apparatus 1 according to the invention. Of course, other arrangements and orientations of the roller groups 2 and 3 are also conceivable. For example, the two roller groups 2 and 3 could also be arranged side by side; in this case, the closing direction s would run on a horizontal plane.

The straightening apparatus 1 described in detail below may be used in a cable processing machine (not shown) for the assembly of cables. The cable processing machine can process electrical cables, for example insulated strands or insulated solid conductors made of copper or steel. The cables to be processed are provided in drums on rolls or as a bundle. The cables fed from drums, rolls or bundles to the cable processing machine are more or less curved and have a twist. The cable must therefore be straightened, for which the straightening apparatus 1 mentioned at the beginning is used.

The cable processing machine can be designed, for example, as a swivel machine that has a swivel unit with a cable gripper. To feed the cable ends to processing stations, such as a grommet station and a crimping station, the swivel unit must be rotated about a vertical axis. A cutting and stripping station is usually arranged on the machine longitudinal axis of the cable processing machine. The cable processing machine then comprises an infeed unit with, for example, a cable conveyor configured as a belt conveyor, which brings the cables to the swivel unit in the transport direction along the machine longitudinal axis. The straightening apparatus 1 is arranged in the cable processing machine upstream of the belt conveyor on the longitudinal axis of the machine. When the cable is fed to the swivel unit, the cable is pulled through the straightening device 1 for straightening the cable 4.

The rollers 20.1 to 20.7 of the first or upper roller group 2 are freely rotatably attached to a first roller support 6. The rollers 21.1 to 21.6 of the lower or second roller group 3 are freely rotatably attached to a second roller support 7. The straightening apparatus further comprises a frame 8 in the form of a base plate for carrying the first and second roller supports 6 and 7. The roller supports 6, 7 are configured plate-like in the present case.

The first roller support 6 with the upper rollers 20.1 to 20.7 is displaceably mounted in the frame 8 in the closing direction s. The second roller support 7 with the lower rollers 21.1 to 21.6 is rotatably mounted in the frame 8 with respect to a horizontal swivel axis indicated by 24 and runs at right angles to the transport direction. The basic structure of the straightening apparatus 1 is similar to the straightening apparatus known from EP 2 399 856 A1; moving the roller support 6 with the upper rollers 20.1 to 20.7 for the infeed process takes place by means of a novel infeed device 5.

The infeed device 5 is configured to be manually operable and comprises an operating element 16 that can be moved linearly in the closing direction s. The first roller support 6 is supported on the frame 8 by a spring element 10 in the form of a helical compression spring, which acts on the first roller support 6 with a spring force against the closing direction s. By pressing the operating element 16, the first roller support 6 can be displaced downward with the upper rollers 20.1 to 20.7. The operating element 16 is pressed down until the rollers 20.1 to 20.7 and 21.1 to 21.6 touch the cable.

For the infeed, the operating element 16 only has to be pressed, which results in particularly simple and ergonomic handling. The second roller support 7 with the lower roller group 3 is not moved during the infeed process. For this purpose, the lower roller group 3 is held by a machine control via a pneumatic valve and a pneumatic cylinder 33 in a position parallel to the upper roller group 2, which corresponds to a neutral position.

In the present example, the operating element 16 has the shape of a button. Of course, other shapes for the operating element 16 would also be conceivable. For example, the operating element 16 could have a bow-like handle.

In order to secure the position of the upper roller group 2 displaced in the closing direction s by the infeed device 5, the straightening apparatus 1 comprises a backstop (9, see FIG. 3 described below), which blocks a backward movement of the upper roller group 2 against the closing direction s. Under certain circumstances, the upper roller group 2 could also be blocked by a clamping mechanism, for example a clamping lever or a pneumatic cylinder.

A freely rotatable contact roller 19 is also arranged on the first roller support 6. The contact roller 19 is arranged on the output side following the upper roller group 2 with respect to the transport direction x and serves to fix the closed position. A counter roller 22 is provided on the second roller support 7 on the side opposite the contact roller 19. If, starting from the open position (FIG. 1), the upper roller group 2 is displaced in the s direction against the second roller group 3, the cable 4 in between comes into contact with the two rollers 19 and 22. The closing movement caused by pressing the operating element 16, thanks to the contact roller 19 and counter roller 22, correctly adjusts the two roller groups 2, 3 to one another for any cable diameter.

As can be seen from FIG. 2, the upper rollers 20.1 to 20.7 touch on one side and the lower rollers 21.1 to 21.6 touch on the other side, the cable 4 in the closed position in such a way that it is still straight. The contact roller 19 and the counter roller 22 cooperating with it ensure that the rollers 20.1 to 20.7 and 21.1 to 21.6 cannot be displaced further into one another, which would lead to a wave-like course of the cable 4 passed between the rollers.

The operator, who presses the operating element 16 downwards, feels an abruptly increasing counter pressure as soon as the cable 4 is pressed between the contact roller 19 and counter roller 22. The operator is thus informed that the infeed process has been completed (FIG. 2) and that he can let go of the operating element 16. Thanks to the backstop 9, it is ensured that after the operating element 16 is released, an undesired return movement of the upper roller group 2 in the opposite direction to the closing direction s or upwards is prevented.

A guide roller 37 is arranged at the front end of the first roller support 6 on the input side. The guide roller 37 has, compared to the rollers 20.1 to 20.7, a larger roller diameter to straighten the cable. The guide roller 37 is, compared to the rollers 20.1 to 20.7, vertically offset slightly downward, so that the guide roller 37, when the straightening apparatus 1 is in the closed position, is positioned below the cable. The guide roller 37 serves to facilitate the insertion of the cable 4 in the open straightening apparatus. The guide roller 37 makes it possible, for example, for the cable 4 to be tensioned by hand before and while the straightening apparatus 1 is closed, so that it can easily be ensured that the cable comes to rest when closing between all the rollers 20.1 to 20.7 and 21.1 to 21.6.

Figure 3:
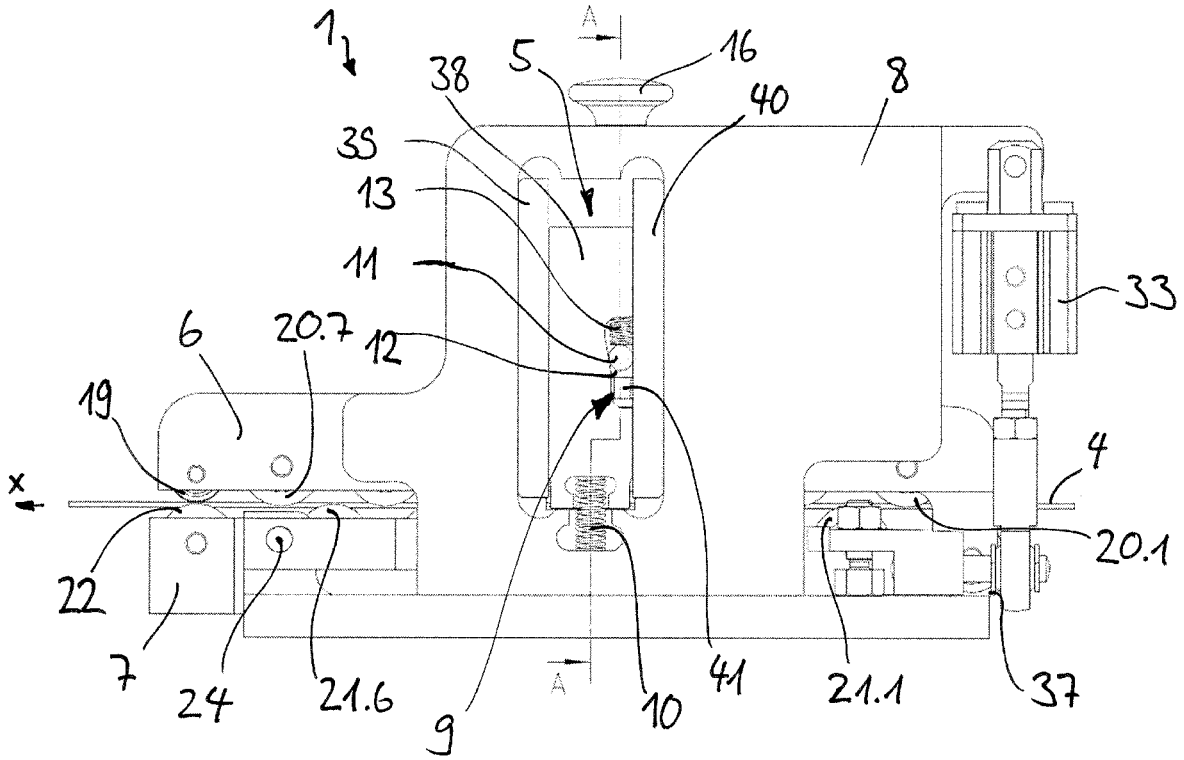
FIG. 3 is a rear view of the straightening apparatus in the closed position.

FIG. 3 shows a rear view of the straightening apparatus 1. The first roller support 6 for the upper rollers 20.1 to 20.7 has a guide section 38 which extends in the vertical direction and which can be guided along two guide plates 39, 40 for sliding movement in the s direction along the guide surface. The guide plates 39, 40 are part of the frame 8. The operating element 16 connects to the guide section 38 of the first roller support 6 at the top.

The backstop already mentioned can be seen in FIG. 3 and is designated by 9 there. The backstop 9 comprises a clamping roller 11 which is received in a wedge gap 12. The wedge gap 12 is a receptacle for the clamping roller 11 that tapers in relation to the closing direction s. The backstop 9 further comprises a spring 13 for generating a pretension for the clamping roller 11. Due to the wedge effect, the clamping roller 11 pressed into the wedge gap 12 can reliably block a return movement of the first roller support 6. By means of the spring 13, the clamping roller 11 is continuously pressed into the wedge gap 12 and thus ensures that the backstop 9 functions reliably. An unlocking element 41 may be seen below the clamping roller 11. This unlocking element 41 may, when it is moved upwards against the clamping roller 11, push the clamping roller 11 upwards and thus cancel the clamping action (see further FIG. 7 described below).

Figure 4:
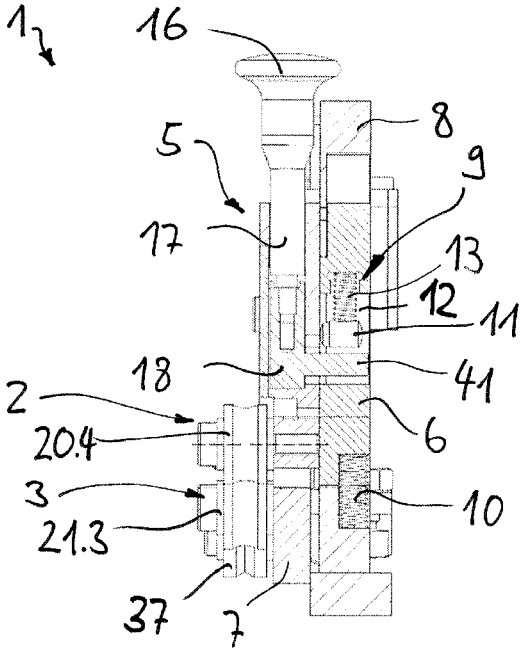
FIG. 4 is a cross section through the straightening apparatus in the closed position (sectional view along section line A-A according to FIG. 3)

Further structural details of the straightening apparatus 1 can be seen in FIG. 4. The button-shaped operating element 16 has a shaft 17 which is fixedly connected to a driver 18. The driver 18 adjoining the shaft 17 serves to advance the first roller support 6 when the operating element 16 is pressed. The driver 18 has a front end with respect to the closing direction s, which contacts the first roller support 6 for advancement at least during the closing. Connected to the driver 18 is a nose-like projection for forming the unlocking element 41 for releasing the locking effect, which is inserted into the wedge gap 12 from the side (cf. following FIG. 6/7).

Figure 5:
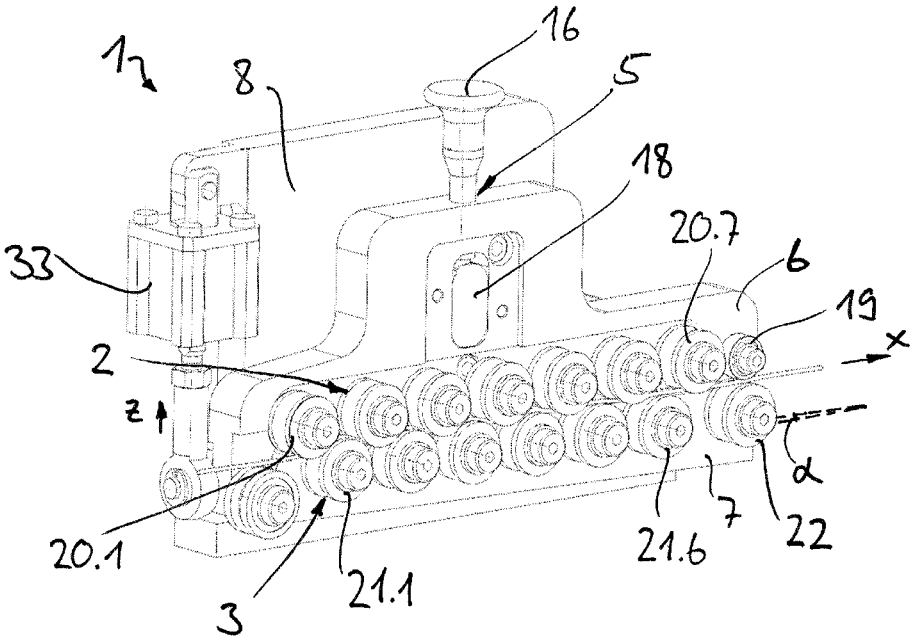
FIG. 5 is a perspective view of the straightening apparatus in an active position.

After the infeed process has ended, the second roller support 7 is swiveled about the swivel axis 24 into an active position in order to produce a sufficient straightening effect, so that the rollers 20.1, 21.1 on the input side act more strongly on the cable 4 than the rollers 20.7, 21.6 on the output side. For this purpose, the front side of the second roller support 7 is pulled upwards by means of a pneumatic cylinder 33, which is indicated in FIG. 5 by an arrow z. The pneumatic cylinder 33 can easily set the desired angle of attack a by appropriate control. Instead of using the pneumatic cylinder 33, designs of straightening apparatuses would also be conceivable in which the swiveling could be carried out manually by means of appropriate means.

In order to prevent the cable 4 from being crimped by the user when the cable is touched by the contact roller and the counter roller during the infeed process, the straightening apparatus 1 can have a device for limiting the force between the operating element 16 and the counter roller 22, for example in that the operating element 16 is at least indirectly connected to the counter roller 22 via a spring (not shown) and the stroke of the operating element 16 is limited by a mechanical stop.

FIG. 5 shows the straightening apparatus 1 in the active position after the second roller support 7 has been swiveled. All rollers 20.1 to 20.7 of the upper roller group 2 lie horizontally on a line and the rollers 21.1 to 21.6 of the lower roller group 3 at an angle of attack a on a line which approaches the entry of the upper roller group 2. The cable 4 should run approximately tangentially on the rollers 20.7, 21.6 at the exit of the straightening apparatus 1 without being bent. The optimal setting of the rollers 20.7, 21.6 on the output side correlates with the outside diameter of the cable 4.

In order to activate the straightening apparatus 1, the machine control (not shown) brings the lower roller group 3 into the active position, either after pressing a special button or automatically within a program sequence, in that the pneumatic cylinder 33 moves the lower roller group 3 to the upper roller group 2 on the input side. The restoration of the original starting position of the straightening apparatus 1 could also be carried out by pressing a button or started automatically within a program sequence. The key or the program sequence could actuate a pneumatic valve or a switch of the machine control, whereupon the lower roller group 3 is moved back via the pneumatic cylinder 33 into the position parallel to the first roller group 2. The machine control could also be configured in such a way that the activation of the pneumatic cylinder 33 for swiveling the lower roller group 3 back from the active position into the parallel neutral position could be triggered by pulling or possibly pressing the button-shaped operating element 16 again.

From FIGS. 1 and 2 it can also be seen that the counter roller 22 to the contact roller 19 is arranged toward the swivel axis 24 such that the counter roller 22 moves away from the contact roller 19 during this movement and releases the pressing or clamping of the cable 4 between the two rollers 19 and 22. The position of the swivel axis 24 is located approximately in the middle between the last lower roller 21.6 and the counter roller 22.

The swivel axis 24 could also assume other positions. For example, the swivel axis 24 could be coaxial with the axis of rotation of the counter roller 22. Furthermore, it would be conceivable to arrange the swivel axis 24 or the rollers 19 and 22 in the straightening apparatus in such a way that when the lower roller group 3 is swiveled they move towards one another and thus cause a slight squeezing effect on the cable. Squeezing can be advantageous for straightening cables with comparatively hard insulation. Such cables can be processed better if they are additionally crimped in diameter during or after straightening. If for this purpose the swivel axis 24, instead of to the left as in the exemplary embodiments shown in FIGS. 1 to 8, were arranged to the right of the counter roller 22, the distance between the rollers 19 and 22 would decrease when swiveling to create the active position and the cable 4 would be crimped accordingly. It would also be conceivable to mount an additional pair of rollers (not shown) downstream of the straightening apparatus for crimping the cable on the cable processing machine.

Figure 6:
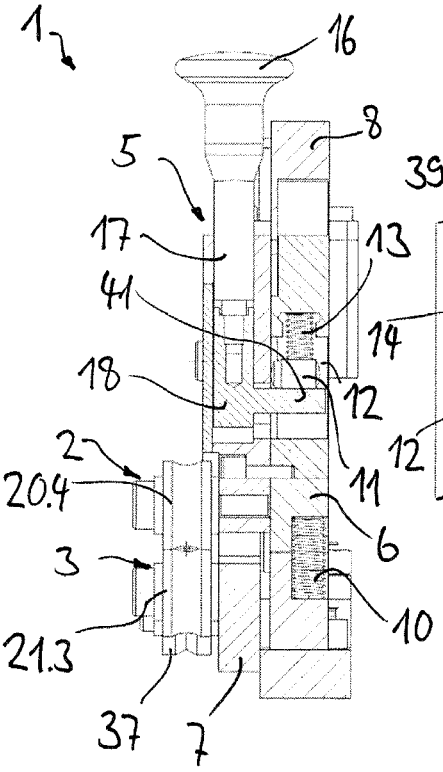
FIG. 6 is a cross section through the still closed straightening apparatus, but with a released backstop.
Figure 7:
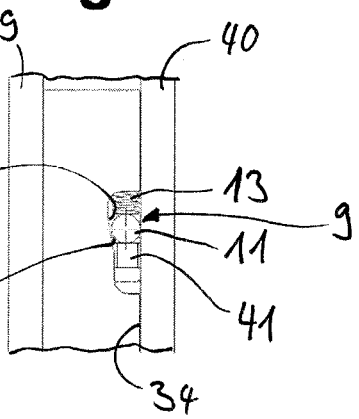
FIG. 7 is an enlarged detailed illustration of the rear view of the straightening apparatus in the closed position with the released backstop from FIG. 6.

It can be seen from FIGS. 6 and 7 how the locking effect can be cancelled or released by the backstop 9. By pulling the operating element 16, the driver 18 with the unlocking element 41 is moved against the closing direction. The front end of the driver 18, which previously contacted the first roller support 6, is released. The unlocking element 41 pushes the clamping roller 11 upward against the force of the spring 13 and thus brings about the lifting of the locking effect. Through the spring force generated by the spring element 10, the thus released first roller support 6 is then moved back to the original position, back to the rest position. The cable 4 can be removed and a new cable can then be inserted. The closing and opening of the straightening apparatus 1 thus take place via a single linear movement, which is ergonomic and takes very little time.

FIG. 7 shows that the wedge gap 12 is formed by a wedge-shaped contact surface 14 assigned to the first roller support 6 and by a stationary counter surface assigned to the frame 8. This counter surface is formed by a guide surface 34 assigned to the frame 8, along which the first roller support 6 can be guided during the closing process.

Figure 8:
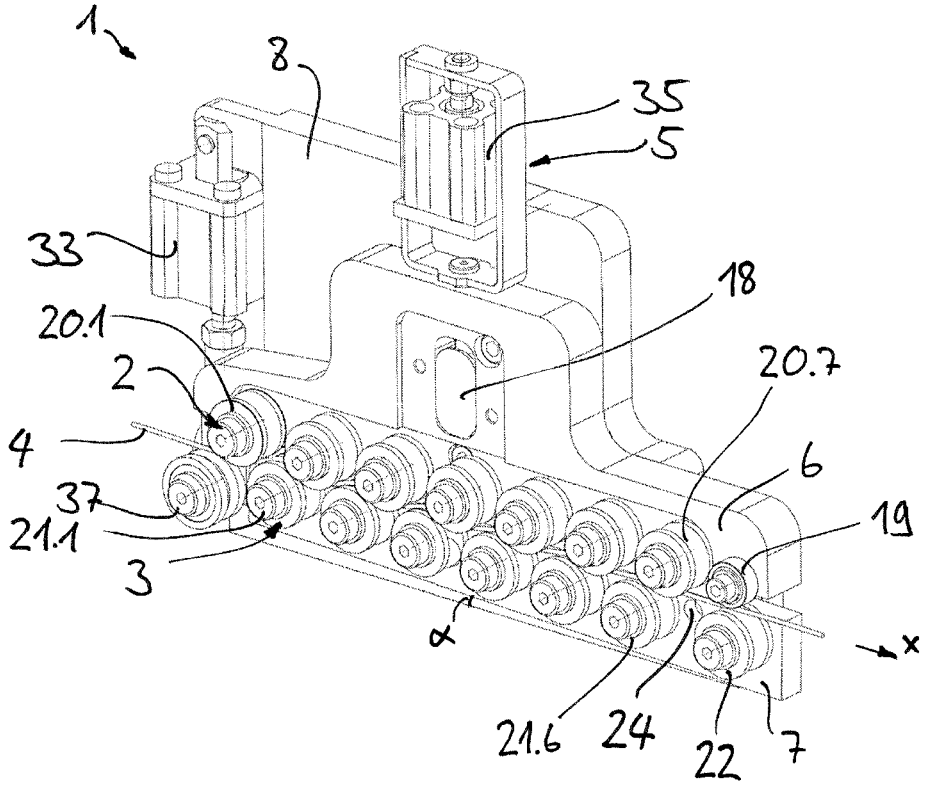
FIG. 8 is a perspective illustration of an alternative straightening apparatus in an active position.

As can be seen from FIG. 8, the infeed device 5 with which the upper roller group 2 may be displaced against the lower roller group 3 for adjusting the distance between the rollers 20.1 to 20.7 and 21.1 to 21.6 of the upper and lower roller groups 2 and 3, is also configured to be driven by a motor. Instead of the button-shaped operating element 16, an actuator 35 is provided with which the upper roller group 2 can be moved vertically downwards for the infeed process. The actuator 35 can be a pneumatic drive, for example. If the manually operable operating element 16 is replaced by the actuator 35, as shown in FIG. 8, the infeed process can be carried out in a cost-effective and process-reliable manner without the intervention of an operator.

Figure 9:
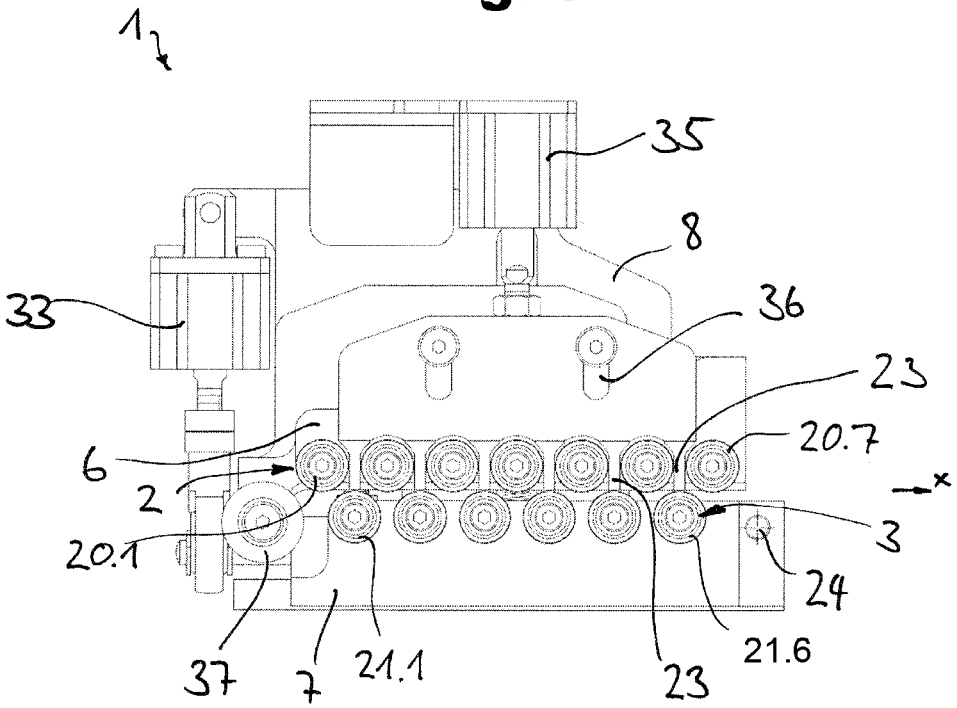
FIG. 9 is a front view of a straightening apparatus according to a third embodiment, wherein the straightening apparatus is in a closed position.

FIG. 9 shows a further variant of the straightening apparatus 1. Instead of contact roller and opposing counter roller according to the previous exemplary embodiments, the straightening device 1 has contact fingers 23 for determining the closed position. The contact fingers 23 are assigned to the upper roller group 2 in the present case. The contact fingers 23 are each arranged opposite to a roller 21.1 to 21.6 of the lower roller group 3, such that the cable 4 can be pressed between the respective contact finger 23 and the opposite roller 21.1 to 21.6. In the exemplary embodiment according to FIG. 9, the straightening apparatus 1 has six contact fingers 23; so in the present example for each of the six lower rollers 21.1 to 21.6 one contact finger 23 each. This has the advantage that the pressure on the contact fingers on cable 4 is distributed evenly and over a larger area. However, it would also be conceivable to provide fewer contact fingers and possibly even only one contact finger. In the variant of the straightening apparatus 1 according to FIG. 9, it is also illustrated that the operating unit (16) can be supplemented or replaced by an actuator 35 for manual actuation to carry out the infeed process.

The contact fingers 23 are pushed upwards after the closing position has been set, so that they are sufficiently far from the cable 4 and can no longer act on the cable, even if there is an active position created by swiveling. For this purpose, a carrier plate, which carries the contact fingers 23, has elongated holes 36, so that the contact fingers 23 or the carrier plate is or are mounted on the first roller support 6 such that they can be displaced in the closing direction to a limited extent.

Figure 10:
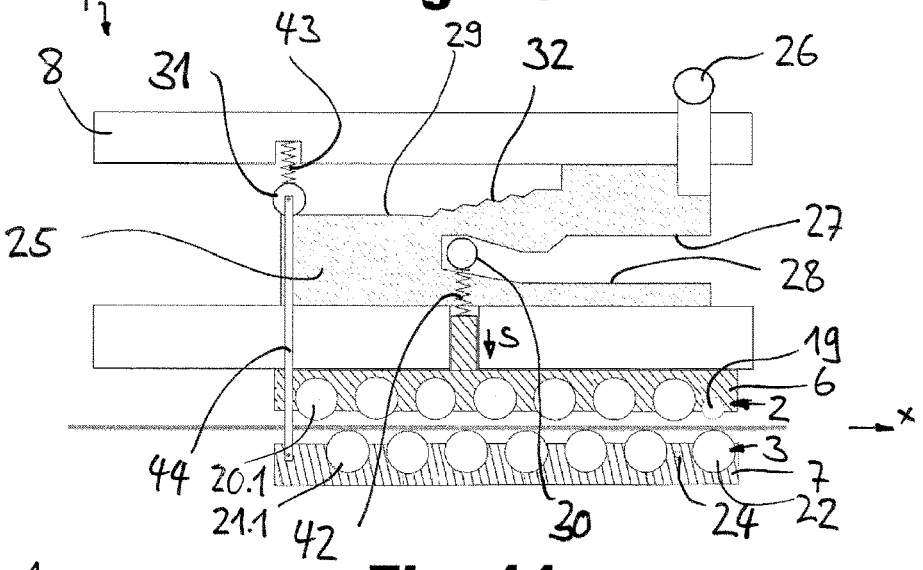
FIG. 10 is a simplified representation of a longitudinal section through an additional straightening apparatus in an open position.
Figure 11:
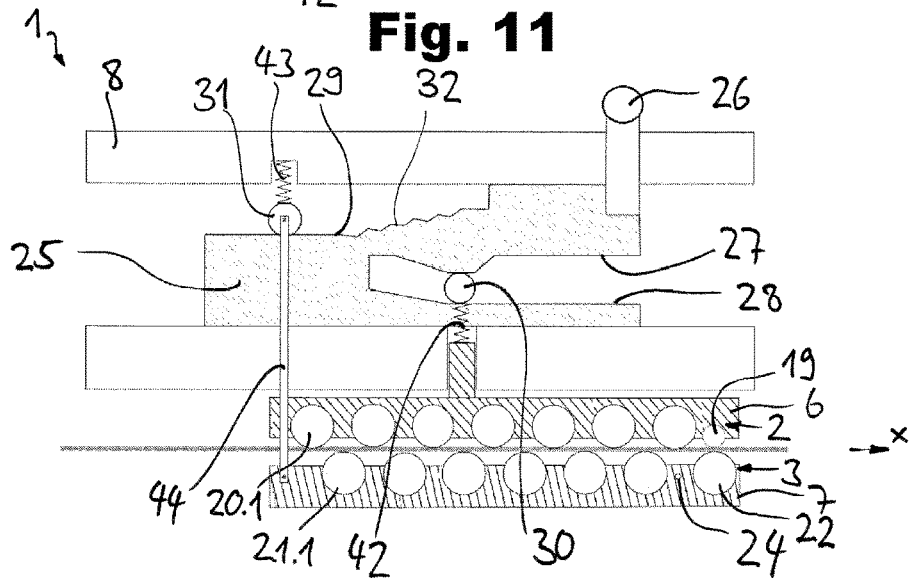
FIG. 11 shows the straightening apparatus according to the embodiment of FIG. 10 in a closed position.
Figure 12:
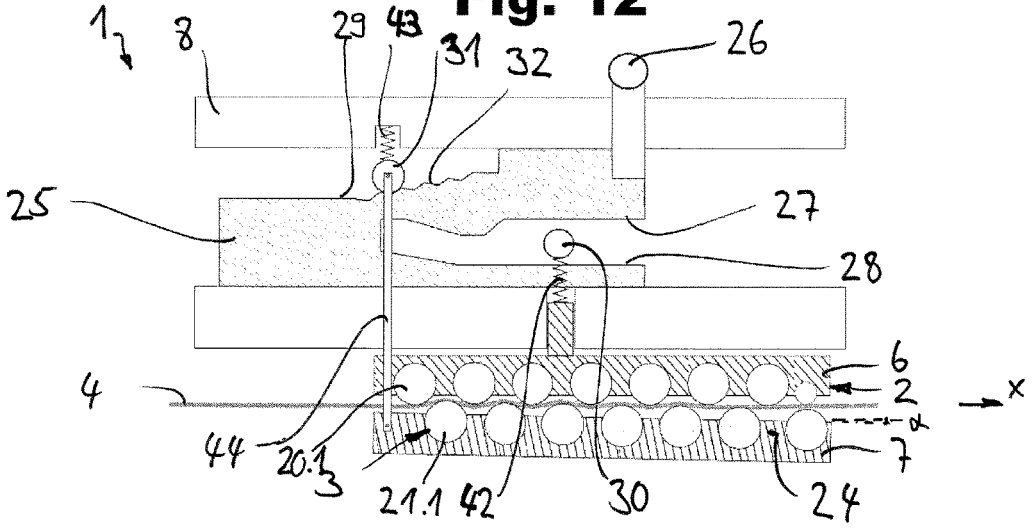
FIG. 12 shows the straightening apparatus in an active position.

FIGS. 10 to 12 relate to a further embodiment of a straightening apparatus 1 which is equipped with the backstop described above but not shown here for simplicity. This straightening apparatus 1 is characterized by a special design of the infeed device 5 for executing the infeed process and the swiveling device 15 for creating the active position. The movement of both roller supports 6 and 7 takes place with the aid of a link control, which is explained below.

The straightening apparatus 1 has a thrust element 25 which can be moved linearly in the transport direction x and via which the first roller support 6 with the upper rollers 20.1 to 20.7 and the second roller support 7 with the lower rollers 21.1 to 21.6 can be moved. In the present case, the thrust element 25 can be actuated manually via a hand lever 26. Instead of the hand lever 26, with which the thrust element 25 can be moved back and forth manually, the thrust element 25 could also be connected to a drive for moving the thrust element 25.

On the thrust element 25, an infeed link guide 27 for displacing the first roller support 6 in the closing direction s is arranged. Furthermore, an opening link guide 28 for releasing the locking effect and for returning the first roller support 6 is arranged on the thrust element 25. The link control comprises a control body, designated by 30, which interacts with the infeed link guide 27 and the opening link guide 28. The control body 30 is supported on the first roller support 6 via a spring 42.

A swivel link guide 29 for swiveling the second roller support 7 is arranged on the thrust element 25, wherein a spring-loaded control body, designated by 31, cooperates with the swivel link guide 29. The spring for generating the spring load on the control body 31 is designated by 43. The spring 43 supports the control body 31 upwards against the frame 8 of the straightening apparatus 1. The control body 31 is connected to the second roller support 7 via a lever 44.

The swiveling link guide 29 can be formed by a continuously rising control path or curve. It can be advantageous if the swiveling link guide 29 is formed by a stepped control track with a plurality of receptacles 32 for the control body 31. Such a link guide 29 with a stepped control path for setting discrete angles of attack is shown in the exemplary embodiment according to FIGS. 10 to 12.

The straightening apparatus 1 has the thrust element 25 with a hand lever 26 and the link guides 27, 28, 29. The thrust element 25 can be moved back and forth with the hand lever 26 relative to the frame 8. The link guide 27 controls the infeed process via the control body 30 designed as a roller, in which the upper roller group 2 is displaced downwards against the lower roller group 3. To set the closed position, this straightening apparatus 1 also has a contact roller 19 and a counter roller 22 opposite it. Alternatively, one or more contact fingers 23 could also be used. The link guide 29 controls the swiveling process via the control body 30 designed as a roller, in which the setting angle $\alpha$ of the lower roller group 3 is set.

The mode of action of the link guide for infeed and swiveling is as follows: The starting point is the open position shown in FIG. 10. The thrust element 25 is pushed to the left. In this case, the control body 30 moving along the infeed link guide 27 presses the roller group 2 via the spring 42 in the closing direction s against the cable 4 until the cable 4 is clamped between the contact roller 19 and the counter roller 22. The infeed process is complete and the closed position has been reached. The straightening apparatus 1 in this closed position is shown in FIG. 11.

As already mentioned above, a good straightening effect is achieved if the rollers 20.1, 21.1, 20.2, 21.2, . . . lie at the entrance in such a way that the cable 4 has to move between the rollers in a wave-like manner such that the cable 4 is curved on every subsequent roller in decreasing intensity. If the thrust element 25 is now pushed further to the left, the spring 42 can relax and the spring (10) (not shown here) with which the first roller support 6 is supported on the frame 8 presses the roller group 2 into the backstop 9. If the thrust element 25 and thus the swivel link guide 29 is pushed further to the left, as shown in FIG. 12, the control body 31 moves along the swivel link guide 29 and thus pulls the lever 44 upward, so that the angle of attack a of the lower roller group 3 is increased and the straightening effect increases. Indentations 32 in the swivel link guide 29 ensure that the control body 31 which is spring-loaded by means of the spring 43 can snap into predefined fixed positions, whereby the active position is reached. With a scale, which indicates the position of the thrust element 25, the user can read off the setting of the straightening effect or adjust it on the basis of default values.

If the thrust element 25 is moved in the opposite direction, that is to the right back to the starting point, the straightening apparatus 1 is accordingly brought back into its open state or open position. The swivel link guide 29 initially sets the lower roller group 3 back into the parallel neutral position via control body 31. The control body 30 moves along the opening link guide 28 and releases the backstop 9, whereupon the upper roller group 2 can be moved into the open position.

It would also be possible, instead of the linearly movable thrust element 25, to also control the two control bodies, for example with cam disks that can be driven in rotation.

A tension spring could also be used instead of the lever 44, so that the angle of attack of the lower roller group 3 is influenced indirectly via the corresponding spring force.

The opposing contact roller 19 and counter roller 22 could also be positioned further toward the swivel axis 24 in such a way that they move towards each other when the upper roller group 2 is infeeding. This achieves a crimping effect that corresponds to that of a so-called clamping roller.

In alternative versions of the straightening apparatus 1, it would be conceivable not to provide a fixed swivel axis 24. In order to enable the user to fine-tune the distance between the two roller groups 2, 3, the swivel axis 24 can be displaced vertically, for example, using an adjusting screw or an eccentric. A device could also be attached to the straightening apparatus 1, which enables a displacement between the frame 8 and the roller group 2.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A straightening apparatus for straightening cables comprising:

a first roller group including a first plurality of rotatable rollers;

a second roller group including a second plurality of rotatable rollers positioned opposite the first roller group wherein a cable moving in a transport direction between the first and second roller groups is touched by the rollers of the first roller group in alternation with the rollers of the second roller group;

an infeed device selectively displacing the first roller group in a closing direction toward the second roller group during an infeed process;

a securing means securing a position of the first roller group displaced in the closing direction by the infeed device; and wherein the securing means includes a backstop that blocks a backward movement of the first roller group against the closing direction during and after the infeed process, and where the backstop includes a clamping body which continuously moves into a wedge gap formed in the straightening apparatus as the first roller group moves in the closing direction.

2. The straightening apparatus according to claim 1 including a first roller support to which the rollers of the first roller group are freely rotatably attached, a second roller support to which the rollers of the second roller group are freely rotatably attached and a frame carrying the first and second roller supports, wherein the first roller support is displaceably mounted on the frame for movement in the closing direction.

3. The straightening apparatus according to claim 2 wherein the first roller support is supported on the frame by a spring element with a spring force acting against the closing direction.

4. The straightening apparatus according to claim 3 wherein the spring element is a helical compression spring.

5. The straightening apparatus according to claim 1 wherein the infeed device is manually operable and has an operating element moveable linearly in the closing direction.

6. The straightening apparatus according to claim 5 wherein the operating element is formed as a button.

7. The straightening apparatus according to claim 5 including a driver connected to the operating element for advancing the first roller support in the closing direction.

8. The straightening apparatus according to claim 1 wherein the clamping body is a clamping roller received in the wedge gap.

9. The straightening apparatus according to claim 1 wherein the backstop includes a spring generating a pretension on the clamping body.

10. The straightening apparatus according to claim 1 wherein the backstop imposes a locking effect on the first roller group and including an unlocking element selectively releasing the locking effect of the backstop.

11. The straightening apparatus according to claim 10 wherein the unlocking element is arranged on a driver and is stopped by the clamping body during a return movement opposite to the closing direction.

12. The straightening apparatus according to claim 1 including a contact roller fixing the closed position, wherein the contact roller is arranged relative to the transport direction on an output side following the first roller group, and wherein the cable is pressed between the contact roller and a counter roller assigned to the second roller group and positioned opposite the contact roller.

13. The straightening apparatus according to claim 1 including at least one contact finger assigned to one of the first and second roller groups, and wherein the at least one contact finger is positioned opposite one of the rollers of another of the first and second roller groups so that the cable is pressed between the at least one contact finger and the opposing one roller.

14. The straightening apparatus according to claim 1 including a frame and wherein the second roller support is rotatably mounted on the frame about a swivel axis and including a swiveling device swiveling the second roller group into an active position.

15. The straightening apparatus according to claim 1 including a link control moving at least one of the first and second roller supports.

16. The straightening apparatus according to claim 15 the link control includes a linearly movable thrust element via which both the first roller support and the second roller support can be moved.

17. The straightening apparatus according to claim 16 wherein the thrust element is manually operable with a hand lever.

18. The straightening apparatus according to claim 16 wherein the backstop imposes a locking effect on the first roller group and the thrust element includes an infeed link guide displacing the first roller support in the closing direction, an opening link guide releasing the locking effect and returning the first roller support, and a swivel link guide swiveling the second roller support arranged on the thrust element.

19. The straightening apparatus according to claim 18 wherein the swiveling link guide is adapted to set discrete angles of attack and is formed as a stepped control track.

* * * * *